US005755080A

United States Patent [19]

Draghetti et al.

[11] Patent Number: 5,755,080

[45] Date of Patent: May 26, 1998

[54] METHOD AND MACHINE FOR PACKING PRODUCTS

[75] Inventors: Fiorenzo Draghetti, Medicina; Marco Brizzi; Roberto Osti, both of Zola Predosa, all of Italy

[73] Assignee: G.D Societa' Per Azioni, Bologna, Italy

[21] Appl. No.: 641,852

[22] Filed: May 2, 1996

[30] Foreign Application Priority Data

| | | | |
|---|---|---|---|
| May 5, 1995 | [IT] | Italy | BO95A0198 |
| Nov. 28, 1995 | [IT] | Italy | BO95A0552 |
| Mar. 8, 1996 | [IT] | Italy | BO96A0121 |

[51] Int. Cl.[6] ..... B65B 11/42; B65B 19/02; B65B 51/00

[52] U.S. Cl. ..... 53/466; 53/202; 53/234; 53/375.9; 53/376.2

[58] Field of Search ..... 53/466, 461, 202, 53/416, 375.9, 376.2, 375.8, 234, 225

[56] References Cited

U.S. PATENT DOCUMENTS

| | | | |
|---|---|---|---|
| 3,605,380 | 9/1971 | Dille | 53/202 |
| 4,269,016 | 5/1981 | Kopp et al. | 53/202 X |
| 4,840,007 | 6/1989 | Focke et al. | 53/202 X |
| 4,909,020 | 3/1990 | Focke | 53/466 |
| 4,936,440 | 6/1990 | Focke et al. | 53/202 X |
| 4,942,715 | 7/1990 | Focke | 53/202 |

*Primary Examiner*—James F. Coan
*Attorney, Agent, or Firm*—Ladas & Parry

[57] ABSTRACT

A method and machine for packing products, whereby packets completed as they travel along a wrapping path are fed successively to a distributing device and selectively fed to an input of one of at least two drying conveyors parallel to each other; and the packets are fed by the drying conveyors at a frequency (F2) lower than the frequency (F1) at which the packets are fed along the wrapping path.

30 Claims, 5 Drawing Sheets

METHOD AND MACHINE FOR PACKING PRODUCTS

BACKGROUND OF THE INVENTION

The present invention relates to a method of packing products.

The present invention is particularly advantageous for use in the tobacco industry, especially for packing cigarettes in rigid hinged-lid packets, to which the following description refers purely by way of example.

On cigarette packing machines, groups of cigarettes, normally enclosed in respective foil wrappings, are fed successively through a number of folding stations located along a wrapping path, along which each group is gradually enclosed inside a respective packet formed by gradually folding a respective blank, which is stabilized in its folded shaped by means of gumming operations.

Using gum to stabilize the packets means that the packets cannot be handled safely until the gum is completely dry. For this reason, known packing machines feature drying conveyors for feeding the finished packets to the output of the machine, while at the same time keeping all the folded parts of each packet correctly positioned until the gum is completely dry.

Unfortunately, in addition to increasing the size and cost of the machine, and despite being made longer and longer, known drying conveyors have consistently been found to fail in achieving the primary objective for which they are designed. In fact, since, on known packing machines, the packets are advanced by the drying conveyor at the same rate as along the wrapping path, any increase in the output capacity of the packing machine results in a corresponding reduction in the length of time the packets remain on the drying conveyor.

SUMMARY OF THE INVENTION

It is an object of the present invention to provide a packing method designed to at least partly eliminate the aforementioned drawback.

According to the present invention, there is provided a method of packing products, the method comprising the steps of feeding the products successively and at a first given frequency along a wrapping path extending through a number of folding stations where a sheet of wrapping material, at least partly coated with gum, is gradually folded about each product to form a respective packet; and feeding the finished packets along drying means to permit said gum to dry; characterized in that the finished packets are fed along the drying means at a second frequency lower than said first frequency.

According to a preferred embodiment of the above method, the finished packets are fed along the drying means along at least two drying paths parallel to each other.

In particular, the finished packets are preferably fed successively to the drying means by means of a distributing device for selectively feeding each packet to an input of a respective said drying path.

The present invention also relates to a machine for packing products.

According to the present invention, there is provided a machine for packing products, the machine comprising first conveyor means for feeding the products successively and at a first given frequency along a wrapping path; a number of folding stations located along the wrapping path, and for gradually folding a sheet of wrapping material, at least partly coated with gum, about each product to form a respective packet; and a drying device in turn comprising second conveyor means for feeding the packets through the drying device; characterized in that said second conveyor means are located in series with the first conveyor means, and are so formed as to feed the packets at a second frequency lower than said first frequency.

According to a preferred embodiment of the above machine, the second conveyor means comprise at least two drying conveyors parallel to each other, and each for feeding the respective packets at said second frequency.

In particular, the drying device preferably comprises one input for successively receiving said packets; and a distributing device interposed between said input and the drying conveyors, and for selectively feeding each packet from the input to a respective said drying conveyor.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 1:
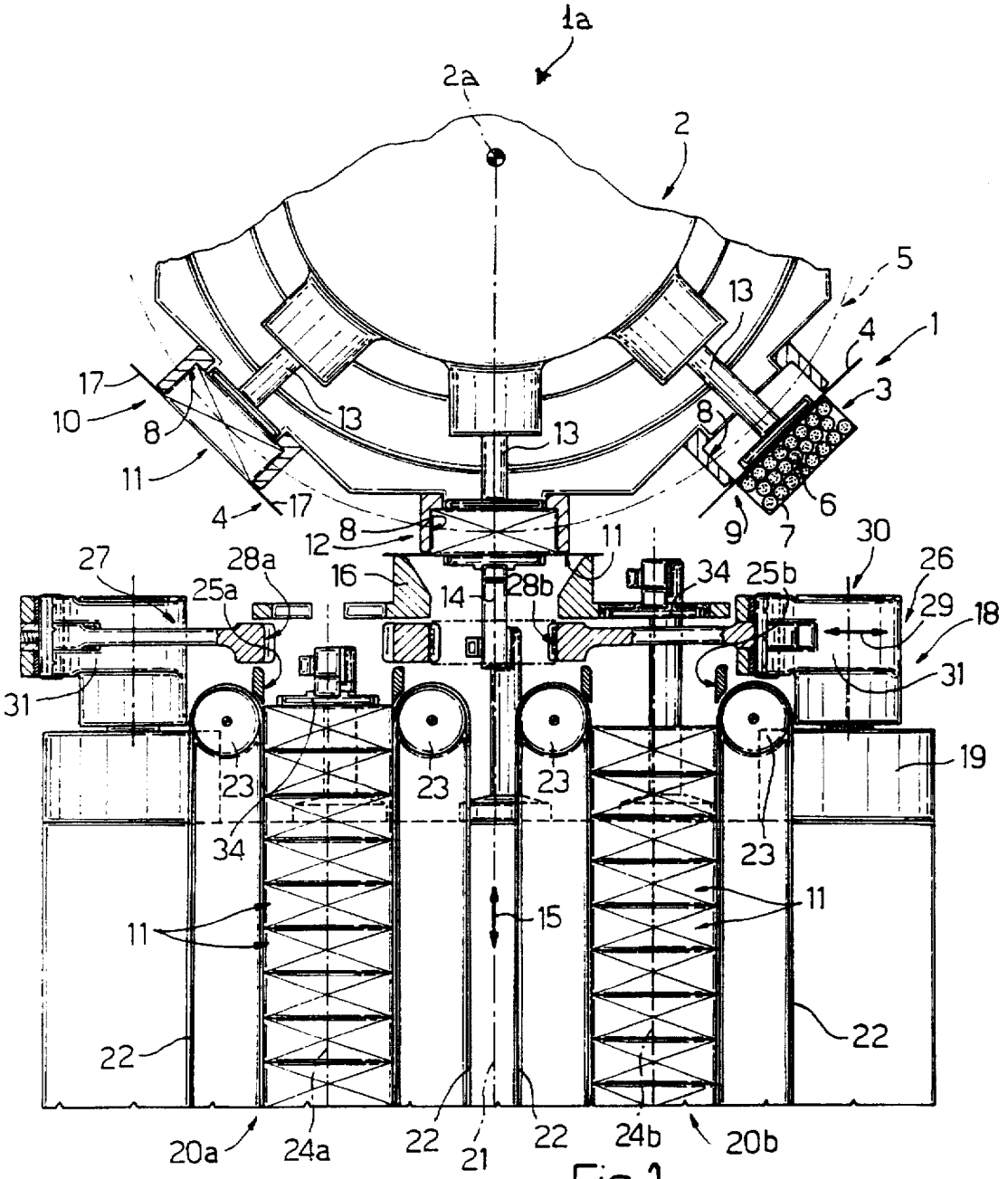
FIG. 1 shows a schematic plan view, with parts in section and parts removed for clarity, of a first preferred embodiment of the packing machine according to the present invention.

Numeral 1 in FIG. 1 indicates a packing machine comprising a conveyor device 1*a*, in turn comprising a wrapping wheel 2 rotating (anticlockwise in FIG. 1) about a vertical axis 2*a* to feed a succession of products 3 and respective sheets of wrapping material—in the example shown, comprising blanks 4—at a given frequency F1 along a circular wrapping path 5 extending about axis 2*a*. Each product 3 comprises a group 6 of cigarettes enclosed in a wrapping 7 of foil, and wheel 2 comprises a number of peripheral seats 8, each for receiving a respective product 3 and a respective blank 4 at a loading station 9, for feeding product 3 and blank 4 through a number of folding stations 10 (only one shown in FIG. 1) distributed along path 5 and where blank 4 is gradually folded about product 3, and for feeding the resulting semi-finished packet 11 to an unloading station 12.

At station 12, a pusher 13 and a counter-pusher 14, movable back and forth in a radial direction 15 in relation to wheel 2, unload each semi-finished packet 11 in known manner from respective seat 8 and through a folding mandrel 16, which folds two longitudinal lateral tabs 17 of blank 4 squarely to complete respective packet 11, which is a rigid hinged-lid packet and, at this point, is substantially in the form of a rectangular parallelepipedon defined laterally by a large front lateral surface and a large rear lateral surface connected to each other by two small lateral surfaces defined by tabs 17. Pusher 13 and counter-pusher 14 also provide for feeding packet 11 to a drying device 18, the input of which is defined by mandrel 16, by feeding packet 11 in direction 15 with the front lateral surface facing device 18.

Drying device 18 is located in series with conveyor device 1*a*, and more specifically, in the FIG. 1 embodiment, with wheel 2, and comprises a fixed supporting frame 19, and two conveyor belts 20—indicated 20a and 20b—parallel to each other and fitted to frame 19 to extend in a direction parallel to direction 15.

Conveyors 20 are positioned symmetrically in relation to the axis 21 of mandrel 16, and each comprise two powered belts 22 looped about respective pairs of pulleys 23 (only one shown) to define a respective drying channel or path 24a, 24b extending in direction 15 from a respective input 25a, 25b.

Figure 2:
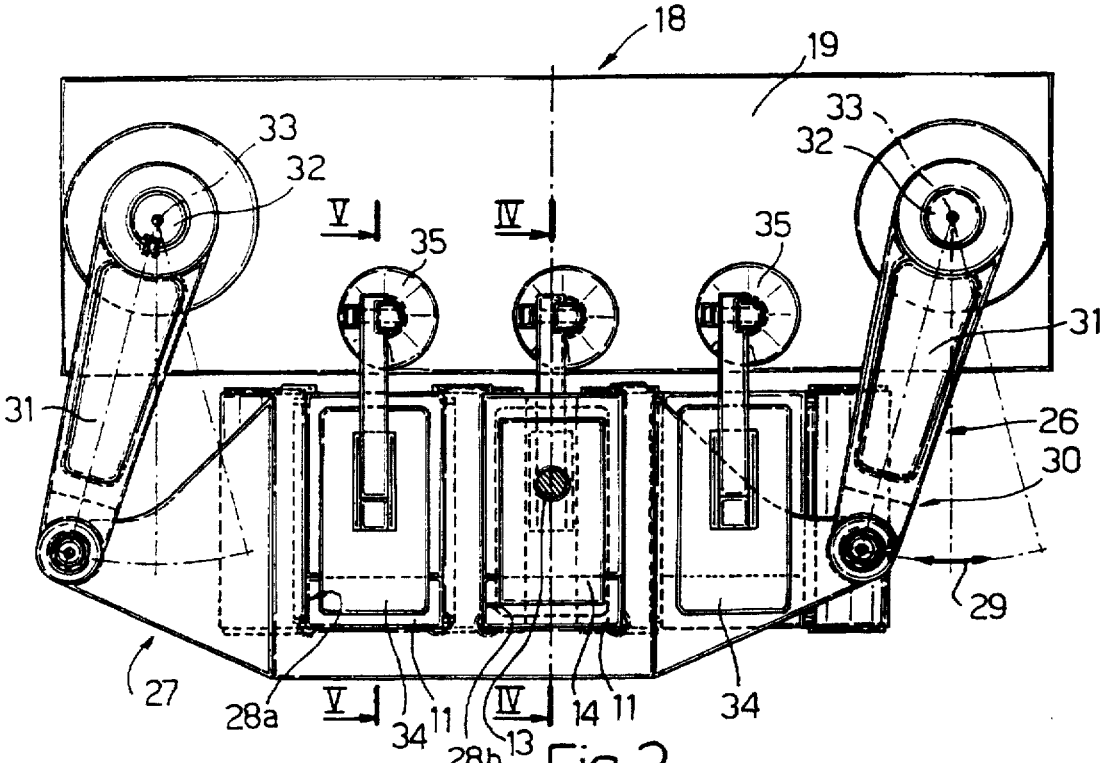
FIGS. 2 and 3 show two end views of a detail in FIG. 1 in two different operating positions.

Drying device 18 also comprises a distributing device 26, in turn comprising a distributing box 27 presenting two transportation compartments 28—indicated 28a and 28b—substantially of the same shape as mandrel 16, and aligned with each other in a direction 29 perpendicular to direction 15 and at a distance from each other equal to the center distance between mandrel 16 and each input 25. Box 27 forms the connecting rod of an articulated parallelogram 30 comprising two cranks 31 extending in a plane perpendicular to direction 15 and fitted to respective shafts 32, one of which is powered. Shafts 32 present respective axes 33 parallel to axis 21, and oscillate about axes 33 to move box 27, in direction 29, between a first position (FIGS. 1, 2 and 4) wherein compartment 28a is aligned with input 25a and compartment 28b is aligned with mandrel 16, and a second position (FIG. 3) wherein compartment 28a is aligned with mandrel 16 and compartment 28b is aligned with input 25b.

Drying device 18 also comprises, for each input 25, a square pusher 34, which is movable back and forth through box 27 and input 25 by a respective linear actuator 35 fitted to frame 19.

In actual use, products 3 are fed successively by wheel 2 along wrapping path 5 at a given frequency F1, and are gradually enclosed inside respective blanks 4, which are partly coated with gum in known manner (not shown) either along path 5 or upstream from station 9. The folding of each blank 4 about respective product 3 results in the formation of a respective packet 11, which is completed, in known manner, as it is expelled from respective seat 8 and fed through mandrel 16.

Pusher 13 and counter-pusher 14 are operated at frequency F1 to successively transfer packets 11 from wrapping path 5 to drying device 18 by so oscillating parallelogram 30 at frequency F1 that, when a packet 11 is located at unloading station 12, a free compartment 28 is positioned coaxially with axis 21.

Figure 3:
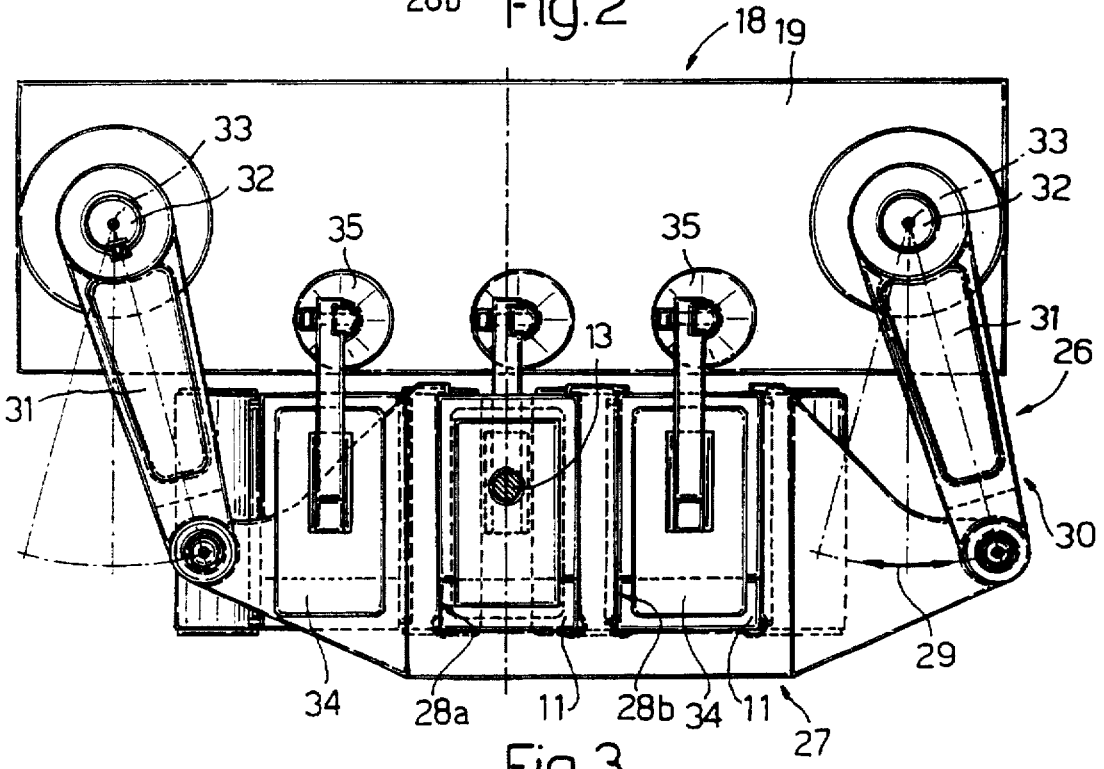
Figure 5:
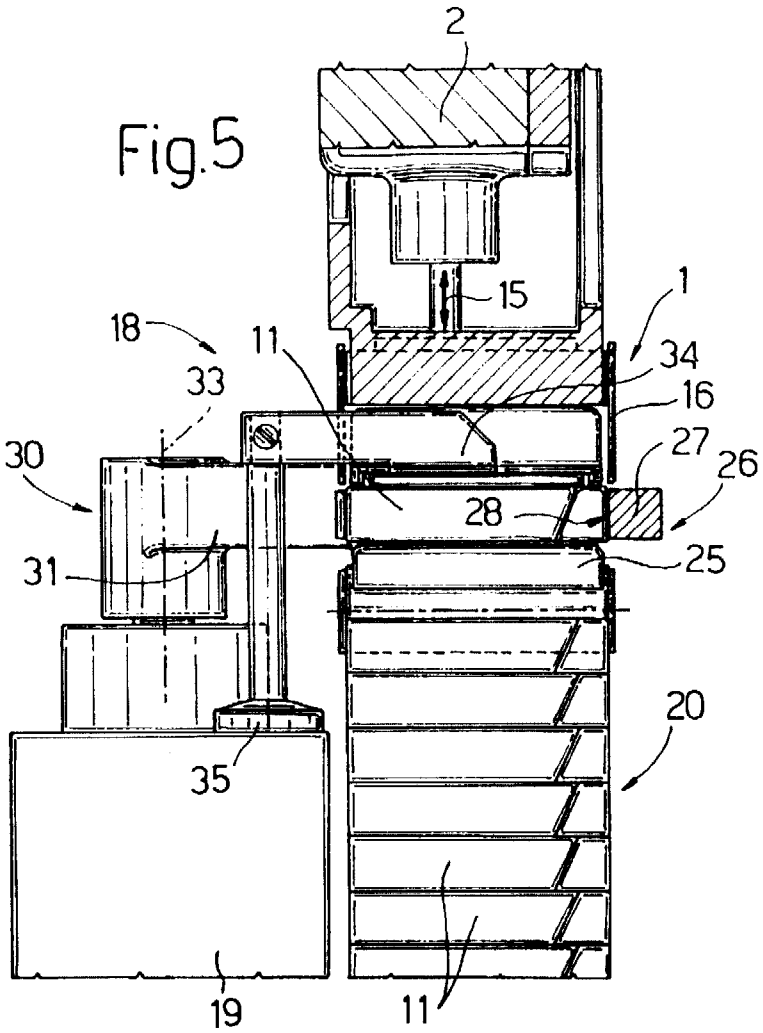
FIG. 5 shows a section along line V—V in FIG. 2.
Figure 4:
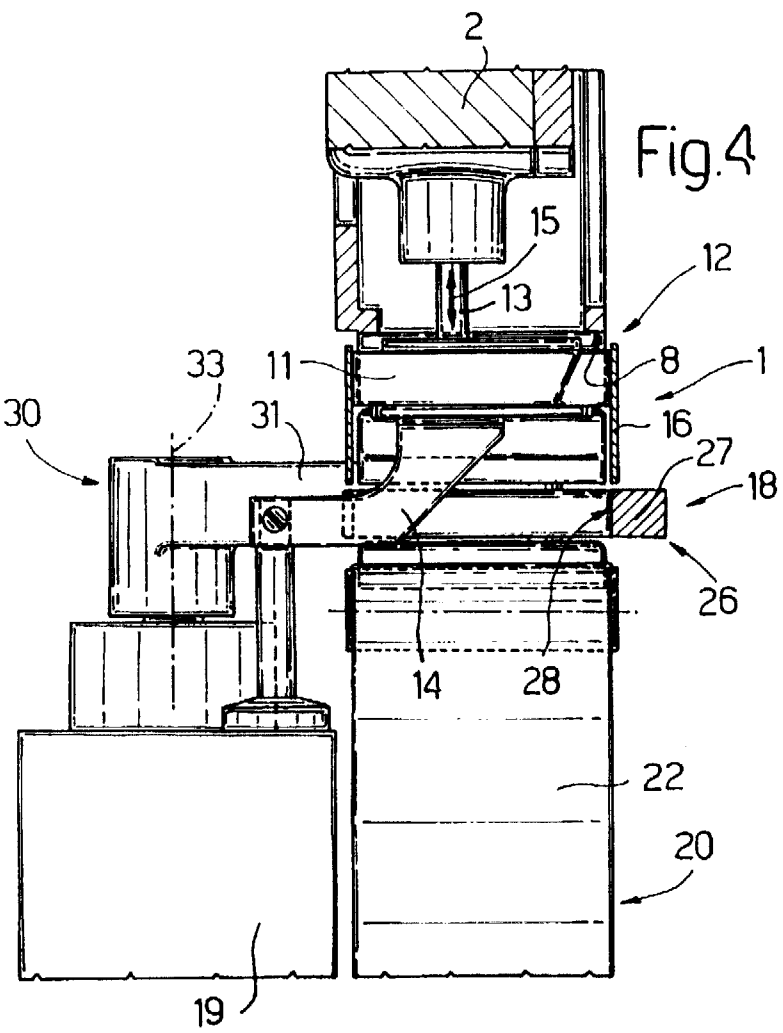
FIG. 4 shows a section along line IV—IV in FIG. 2.

Upon packet 11 being transferred by pusher 13 and counter-pusher 14 from respective seat 8 to said free compartment 28 in direction 15, box 27 is so moved as to transfer compartment 28, e.g. compartment 28a in FIG. 3, from the occupied position shown in FIG. 3 to the occupied position shown in FIG. 4 wherein compartment 28a is positioned coaxial with input 25a and the free compartment 28b is positioned coaxial with axis 21.

At this point, pushers 13 and 34 and counter-pusher 14 are operated simultaneously so that a first packet 11 is expelled from compartment 28a and fed along path 24a, and a further packet 11 is expelled from respective seat 8 into compartment 28b.

By repeating the above cycle, packets 11 are fed selectively and alternately to drying paths 24a and 24b, along each of which packets 11 are fed at a frequency F2 lower than frequency F1 (in the example shown, equal to half of frequency F1), thus enabling longer drying times for a given output speed of machine 1 and a given length of drying device 18.

Figure 6:
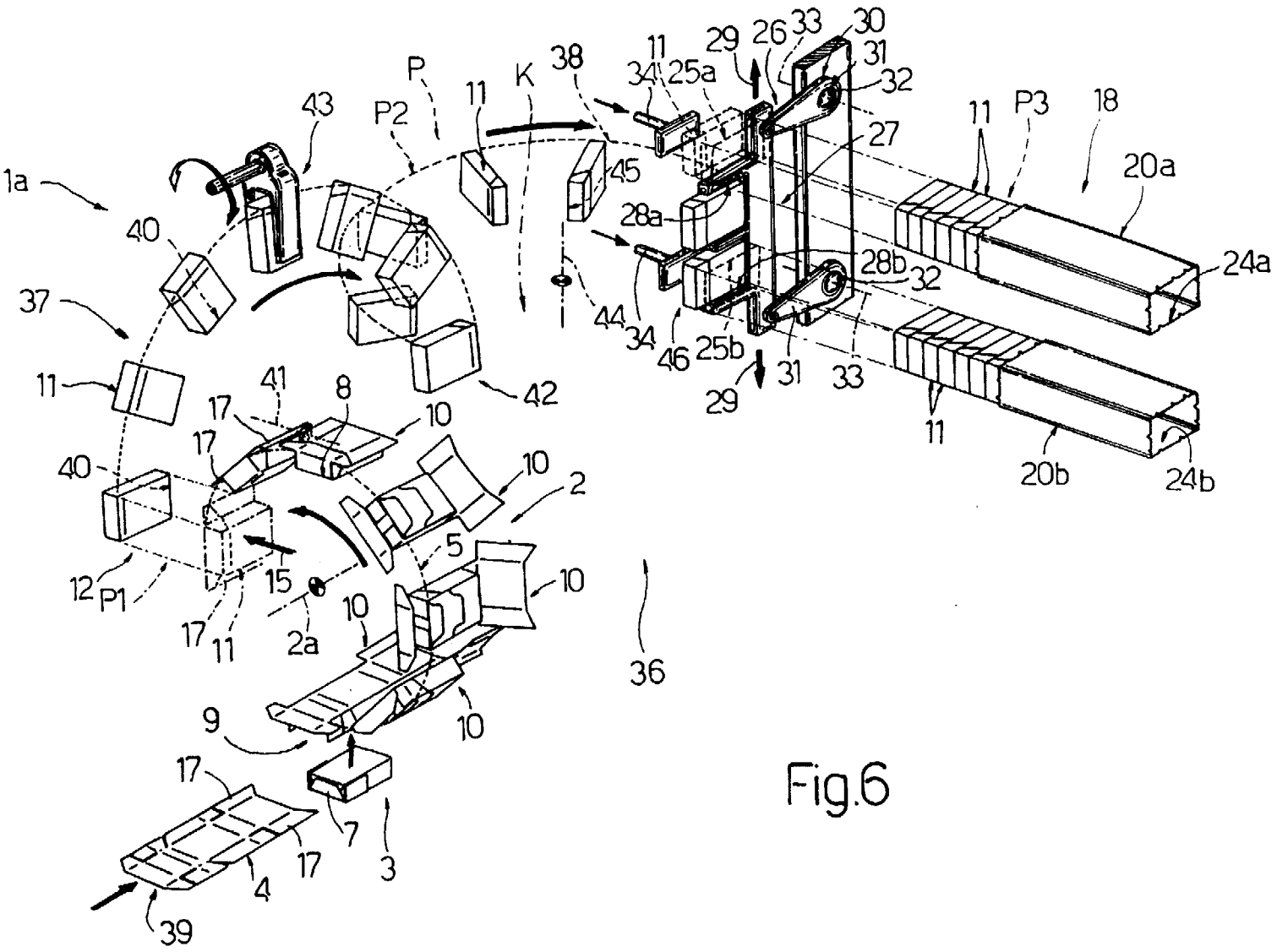
FIGS. 6 and 7, show two schematic views, with parts removed for clarity, of a further two preferred embodiments of the packing machine in FIG. 1.

The variation shown in FIG. 6 relates to a packing machine 36 similar to packing machine 1, except that, in this case, conveyor device 1a and drying device 18 extend along a substantially horizontal, substantially U-shaped path P comprising an input arm P1 defined, at least at the end portion, by wrapping wheel 2, and an output arm P3 defined by conveyors 20 and located parallel to and to the side of arm P1. Also, conveyor device 1a comprises a further two wheels 37 and 38 located in series with each other along an intermediate arm P2 connecting and crosswise to arms P1 and P3.

Arm P1 is defined, at least at the end portion, by wrapping wheel 2, the axis 2a of which, in this case, is positioned horizontally; wheel 2 is supplied, at station 9, with both a succession of groups 6 of cigarettes, and a succession of blanks 4, which are fed in known manner onto wheel 2 by a supply line 39 parallel to axis 2a, to form a succession of rigid hinged-lid packets 11; and seats 8 of wheel 2 are so positioned about the periphery of wheel 2 as to receive a respective group 6 with its large lateral surfaces parallel to axis 2a, and its rear lateral surface facing the bottom of seat 8 and contacting a portion of respective blank 4.

At unloading station 12, each packet 11 is fed in direction 15, and perpendicularly to its large lateral surfaces, into a respective seat 40 formed on the periphery of wheel 37, which is a transfer wheel rotating clockwise (in FIG. 6) about a horizontal axis 41 perpendicular to axis 2a. Wheel 37 defines the input portion of arm P2, and provides for successively feeding packets 11 from station 12 to a transfer station 42 diametrically opposite station 12 in relation to axis 41, and via a known reject device 43 for unloading off machine 36 any faulty packets 11 detected during known checks performed both up- and downstream from station 12.

Axes 2a and 41 define a substantially horizontal plane K, and wheel 37 is located with its front surface facing the outer periphery of wheel 2. Each seat 40 is formed as of the outer periphery of wheel 37, and is so oriented as to convey packets 11 with their longitudinal axes positioned radially, with their large lateral surfaces perpendicular to axis 41, and with their large rear lateral surfaces facing wheel 2.

Wheel 38 is a turnover wheel defining the output portion of arm P2, is mounted for rotation about a vertical axis 44 perpendicular to turnover plane K, is located substantially in plane K and substantially tangent to wheel 37 at station 42, and presents a number of radial seats 45, each for receiving a respective packet 11 from wheel 37 at station 42.

More specifically, wheel 38 feeds seats 45 in steps along plane K, and arrests each seat 45 at station 42, where a respective packet 11 is fed into each seat 45 from a respective seat 40, and is retained inside and fed by seat 45 along plane K. When housed inside respective seat 45, each packet 11 is positioned with its lid facing radially inwards of wheel 38, with its small lateral surfaces parallel to plane K, and with respective tabs 17 folded in the opposite direction to the rotation direction of wheel 38.

Wheel 38 transfers packets 11, crosswise to their front and rear surfaces, from station 42 to a station 46 defining the output end of arm P2 and diametrically opposite station 42. Station 46 defines, with station 42 and along the periphery of wheel 38, an arc of 180° located in plane K and along which each packet 11 is turned over about an axis parallel to axis 44. At station 46, each seat 45 is aligned with mandrel 16, and each packet 11, housed inside respective seat 45, is engaged by distributing device 26, which defines the input end of arm P3 and is movable between said first and second operating positions to alternately transfer packets 11 to the two drying conveyors 20 located one over the other on either side of and symmetrically in relation to plane K.

Distributing box 27 of distributing device 26 is movable back and forth between said first and second positions in direction 29, which in this case is perpendicular to plane K, to align compartments 28 alternately with mandrel 16 and a stationary seat 45 in station 46, and to enable packets 11 to be transferred by means of pushers 34 to conveyors 20, as described previously, with their front face facing conveyors 20.

Operation of packing machine 36 will be clear from that of packing machine 1 already described, and therefore needs no further explanation.

Figure 7:
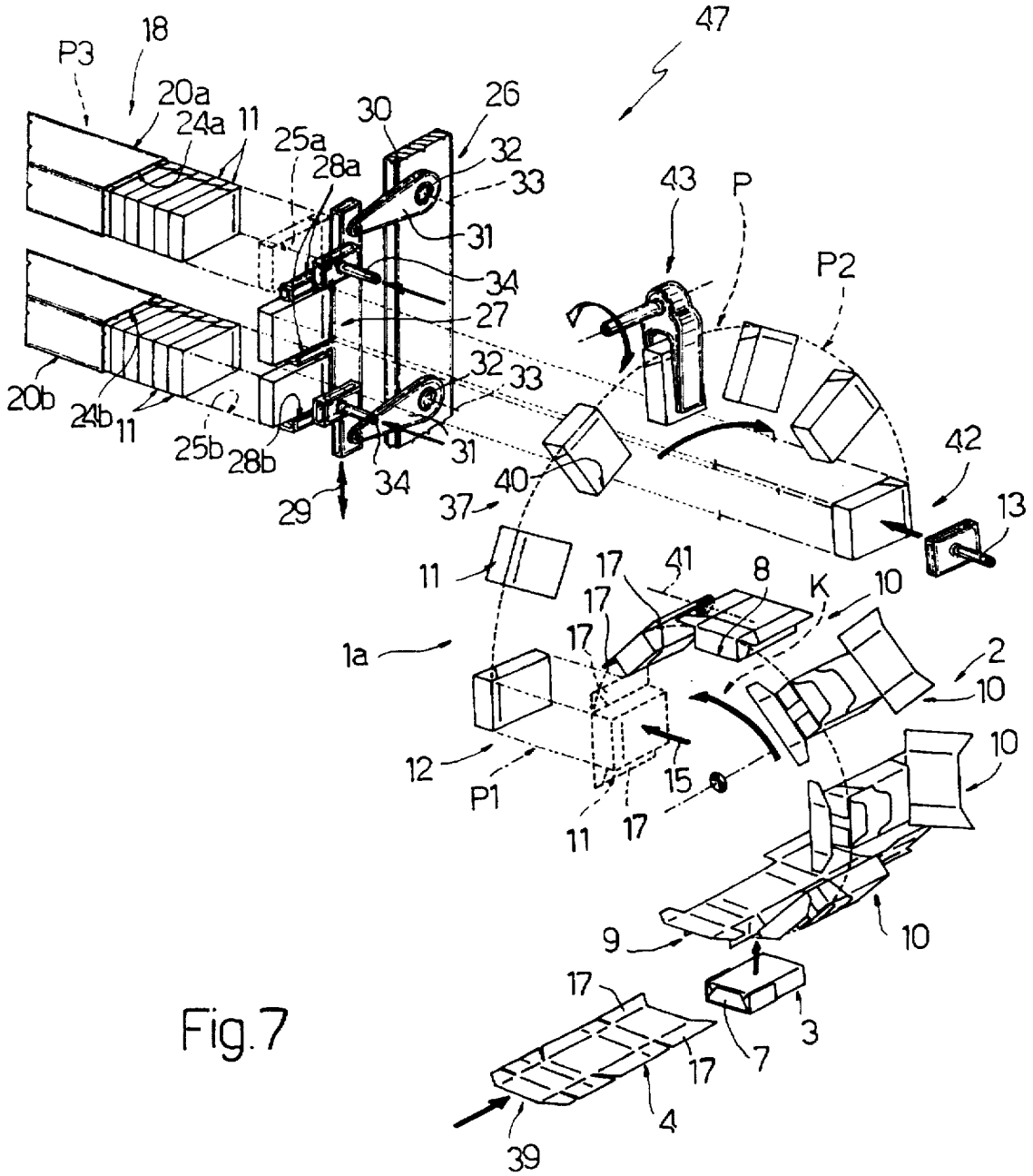

The variation shown in FIG. 7 relates to a packing machine 47 similar to packing machine 36, except that wheel 38 is dispensed with, and distributing device 26 is located at station 42. In this case, packets 11 are transferred directly from wheel 37 to drying device 18 at station 42, which defines the output end of arm P2; and arms P1 and P3 are parallel to each other and located crosswise to and on either side of arm P2.

Operation of packing machine 44 will be clear from that of packing machine 36 already described, and therefore needs no further explanation.

Finally, according to a variation not shown, provision is made for more than two parallel drying paths 24, which are associated with a distributing box or distributing wheel with more than two compartments.

We claim:

1. A method for packing products (3), the method comprising the steps of feeding the products (3) successively and at a first given frequency (F1) along a wrapping path (5) extending through a number of folding stations (10) where a sheet (4) of wrapping material, at least partly coated with gum, is gradually folded about each product (3) to form a respective packet (11); and feeding the finished packets (11) along drying means (18) at a second frequency (F2) lower than said first frequency (F1) to permit said gum to dry; said packets (11) being fed along a path (P) comprising a first arm (P1) defined at least partly by said wrapping path (5); a second arm (P2) crosswise to the first arm (P1); and a third arm (P3) parallel to the first arm (P1) and defined at least partly by at least two drying paths (24) of said drying means.

2. A method as claimed in claim 1, wherein said at least two drying paths (24) are parallel to each other.

3. A method as claimed in claim 2, wherein the finished packets (11) are fed successively to the drying means (18) by means of a distributing device (26) for selectively feeding each packet (11) to an input (25) of a respective said drying path (24).

4. A method as claimed in claim 3, wherein said packets (11) are rigid hinged-lid packets presenting a large front lateral surface, a large rear lateral surface, and two small lateral surfaces; the packets (11) being fed successively to said drying means (18) with said front lateral surface facing the input (25) of said drying paths (24).

5. A method as claimed in claim 4, wherein the packets (11) are turned over by 180° along said path (P); the path (P) being substantially U-shaped, and said third arm (P3) being located to the side of the first arm (P1).

6. A method as claimed in claim 4, wherein the packets (11) are fed along said second arm (P2) crosswise to the respective small lateral surfaces.

7. A method as claimed in claim 4, wherein said input (25) is located at an output end (42) of said second arm (P2), and the packets (11) are fed to said output end (42) with their large lateral surface facing the third arm (P3).

8. A method as claimed in claim 5, wherein the packets (11) are turned over by 180° along said second arm (P2); said input (25) being located at an output end (46) of said second arm (P2), and the packets (11) being fed to said output end (46) with their large lateral surface facing the third arm (P3).

9. A machine for packing products (3), the machine comprising first conveyor means (1*a*) for feeding the products (3) successively and at a first given frequency (F1) along a wrapping path (5); a number of folding stations (10) located along the wrapping path (5) for gradually folding a sheet (4) of wrapping material, at least partly coated with gum, about each product (3) to form a respective packet (11); and a drying device (18) in turn comprising second conveyor means (20) for feeding the packets (11) through the drying device (18); said second conveyor means (20) being located in series with the first conveyor means (1*a*), and formed to feed the packets (11) at a second frequency (F2) lower than said first frequency (F1), a first wheel (2) mounted along said wrapping path for rotation about a first vertical axis (2*a*) to fold said sheets (4) of wrapping material about said products (3) along said wrapping path (5); said first wheel (2) having an unloading station (12), and unloading means (26) located at said unloading station (12) to successively unload the packets (11) from said first wheel (2).

10. A machine as claimed in claim 9, wherein said unloading means (26) comprise said distributing device (26); the distributing device being movable in a direction (29) crosswise to said first axis (2*a*).

11. A machine as claimed in claim 9, characterized in that the second conveyor means (20) comprise at least two drying conveyors (20) parallel to each other, and each for feeding the respective packets (11) at said second frequency (F2).

12. A machine as claimed in claim 11, characterized in that the drying device (18) comprises one input (16) for successively receiving said packets (11); and a distributing device (26) interposed between said input (16) and the drying conveyors (20), and for selectively feeding each packet (11) from the input (16) to a respective said drying conveyor (20).

13. A machine as claimed in claim 12, wherein said at least two drying conveyors (20) have respective input ends (25) facing said input (16); the distributing device (26) being interposed between said input (16) and the input ends (25) of the drying conveyors (20), and selectively feeding each packet (11) from the input (16) to a respective said input end (25).

14. A machine as claimed in claim 13, wherein said distributing device (26) is a box type distributing device.

15. A machine as claimed in claim 12, wherein said at least the two drying conveyors (20) are located one over the other, and have respective input ends (25) facing said input (16).

16. A machine as claimed in claim 15, wherein said packets (11) are rigid hinged-lid packets having a large front lateral surface, a large rear lateral surface, and two small lateral surfaces; said first and second conveyor means (1*a*, 20) defining a path (P) along which the packets (11) are fed, and which extends substantially in one plane (K) and comprises a first arm (P1) defined at least partly by said first wheel (2); a second arm (P2) crosswise to the first arm (P1) and defined at least partly by a second conveyor wheel (37) rotating about a second axis (41) crosswise to the first axis (2*a*); and a third arm (P3) parallel to the first arm (P1) and defined at least partly by said drying device (18).

17. A machine as claimed in claim 16, wherein said at least two drying conveyors (20) have respective input ends (25) facing an output end of the second arm (P2).

18. A machine as claimed in claim 17, wherein said unloading means (26) successively unloads the packets (11) from the first wheel (2) with their front lateral surface frontwards; said second wheel (37) feeding the packets (11) along said second arm (P2) crosswise to their small lateral surfaces.

19. A machine as claimed in claim 17, wherein said second wheel (37) has an unloading station (42) coincident with said output end of the second arm (P2).

20. A machine as claimed in claim 19, said unloading means (26) located is connected to the second wheel (37) to successively unload the packets (11) from the second wheel (37); said unloading means (26) comprising said distributing device (26).

21. A machine as claimed in claim 20, wherein said distributing device (26) is located between said output end (42) and said input ends (25), and is movable in a direction (29) crosswise to said plane (K) to alternately connect the input ends (25) to the output end.

22. A machine as claimed in claim 18, wherein the first conveyor means (1*a*) comprises turnover means (38) located along said path (P) for turning said packets (11) over by 180° to feed the packets (11) to said output end with their front lateral surface facing the third arm (P3); said path (P) being substantially U-shaped, and said third arm (P3) being located to the side of the first arm (P1).

23. A machine as claimed in claim 22, wherein said turnover means (38) is located along said second arm (P2).

24. A machine as claimed in claim 22, wherein said turnover means (38) is interposed between said second wheel (37) and said output end.

25. A machine as claimed in claim 22, wherein said turnover means (38) comprises a third conveyor wheel (38) rotatable about a third axis (44) crosswise to said plane (K) and parallel to the direction (29) of movement of said distributing device (26); the third wheel (38) rotating in said plane (K) to feed the packets (11) along a 180° arc and crosswise to their front lateral surface.

26. A machine as claimed in claim 25, wherein said third wheel (38) has an unloading station (46) coincident with said output end.

27. A machine as claimed in claim 26, wherein said unloading means (26) is located at said output end and is connected to the third wheel (38) to successively unload the packets (11) from the third wheel (38); said unloading means (26) comprising said distributing device (26).

28. A machine as claimed in claim 14, wherein the distributing device (26) comprises a distributing box (27) having at least two compartments (28), each for receiving a respective said packet (11); actuating means (30) for moving said distributing box (27) to selectively move each compartment (28) between a first position aligned with said input (16), and a second position aligned with a respective said drying conveyor (20); and transfer means (34) aligned with each said output end to transfer the packets (11) from the distributing box (27) to the respective drying conveyor (20).

29. A machine as claimed in claim 28, wherein said actuating means (30) comprises an articulated parallelogram (30).

30. A machine as claimed in claim 29, wherein the distributing box (27) forms a connecting rod of said articulated parallelogram (30).

* * * * *